United States Patent [19]

Hauffe et al.

[11] Patent Number: 4,867,853

[45] Date of Patent: Sep. 19, 1989

[54] PROCESS OF PRODUCING PHOSPHATE COATINGS

[75] Inventors: Dieter Hauffe; Rainer Kühna, both of Frankfurt am Main; Gerhard Müller, Hanau; Werner Rausch, Oberursel; Helmut Schümichen, Frankfurt am Main, all of Fed. Rep. of Germany

[73] Assignee: Metallgesellschaft Aktiengesellschaft, Frankfurt am Main, Fed. Rep. of Germany

[21] Appl. No.: 106,165

[22] Filed: Oct. 7, 1987

[30] Foreign Application Priority Data

Oct. 17, 1986 [DE] Fed. Rep. of Germany ..... 3635343

[51] Int. Cl.[4] ..... C25D 13/00

[52] U.S. Cl. ..... 204/181.3; 106/14.14

[58] Field of Search ..... 204/181.3; 106/14.14

[56] References Cited

U.S. PATENT DOCUMENTS

| | | | |
|---|---|---|---|
| 2,815,328 | 12/1957 | Green | 252/75 |
| 3,007,817 | 11/1961 | Cavanagh et al. | 148/6.15 |
| 3,960,676 | 6/1976 | Miyosawa | 204/38 A |
| 4,311,535 | 1/1982 | Yasuhara | 148/6.15 Z |
| 4,539,051 | 9/1985 | Hacias | 148/6.15 Z |

FOREIGN PATENT DOCUMENTS

| | | |
|---|---|---|
| 675956 | 6/1966 | Belgium . |
| 3217145 | 10/1983 | Fed. Rep. of Germany . |
| 3217145A | 11/1983 | Fed. Rep. of Germany . |
| 1291347 | 3/1962 | France . |
| 932970 | 7/1963 | United Kingdom . |
| 1065069 | 4/1967 | United Kingdom . |

OTHER PUBLICATIONS

*Chemical Abstracts,* vol. 100, "Cleaning, Degreasing and Activation of Metal Surfaces", Morlock, R. (1984).

*Primary Examiner*—John F. Niebling
*Assistant Examiner*—Isabelle Rodriguez
*Attorney, Agent, or Firm*—Felfe & Lynch

[57] ABSTRACT

Disclosed is a process of producing a phosphate coating on a composite part consisting of steel and galvanized steel, which comprises alkaline cleaning, rinsing with an aqueous rinsing bath, and phosphatizing with an aqueous zinc phosphate solution. The formation of a non-uniform coating and of spots is avoided in the process of the invention by the use of a rinsing bath which contains at least 0.2 g/l alkali borate, at least 0.1 g/l alkali silicate and at least 0.05 g/l alkali nitrite, and which preferably contains said components in a total up to 5 g/l.

If the composite part is to be activated with an activating bath which contains titanium phosphate before being contacted with the zinc phosphate solution, the activating bath must contain at least 1 g/l and preferably up to 4 g/l of tetraalkalipyrophosphate.

The process of the invention can be used to prepare composite parts of steel and galvanized steel for subsequent painting, particularly by electrophoretic dip painting.

11 Claims, No Drawings

PROCESS OF PRODUCING PHOSPHATE COATINGS

The present invention is in a process for producing phosphate coatings on composite parts consisting of steel and galvanized steel, which comprises alkaline cleaning, rinsing with an aqueous rinsing bath, and phosphatizing with zinc phosphate. The invention is also in the use of the process for preparing the composite parts for painting thereafter, particularly electrophoretic dip painting.

It is presently the usual practice to coat composite parts of steel and galvanized steel, such as automobile bodies, with zinc phosphate before an electrophoretic dip painting. For such phosphatizing, the following treatments are performed by spraying, spraying and dipping, or dipping: alkaline cleaning in one or more steps, rinsing with water in one or more steps, activating with an aqueous suspension of titanium phosphate (if required), phosphatizing with zinc phosphate, rinsing with water in one or more steps, a passivating by after rinsing (in most cases), and rinsing with deionized water.

Difficulties sometimes arise in that sequence of operations which result in the formation of phosphate layers which lack uniformity in color and thickness. Whitish dots or areas (spots), which consist of efflorescent crystals may be formed on galvanized steel. Phosphate layers having the properties described may seriously disturb the formation of uniform coatings by electrolphoretic dip painting. It has been found by a more exact analysis of the phenomena that the nonunifority will be more pronounced if the rinsing times between the alkaline cleaning and the coating with zinc phosphate are excessively long and/or the rinsing waters are contaminated by chloride and/or sulfate.

It is an object of the invention to provide a process for the production of phosphate coatings on composite parts consisting of steel and galvanized steel in which the above mentioned disadvantages will not occur and which nevertheless can be carried out in a simple manner and without substantial additional costs.

THE INVENTION

That object and others are accomplished in the process of the invention. In the invention the cleaned composite parts are rinsed with a rinsing bath which contains at least 0.2 g/l alkali borate, at least 0.1 g/l alkali silicate and at least 0.05 g/l alkali nitrite.

The term "steel" covers plain carbon steel to low-alloy steel, such as is used in the form of sheets in the manufacture of vehicle bodies. The term "galvanized steel" covers, e.g., steels which have been coated with zinc or zinc alloys, such as ZnNi, ZnFe, ZnAl, by electrode position or by being dipped into a molten bath.

The alkaline cleaning may be carried out in one or more steps with aqueous alkaline solutions, which contain a surfactant, and serves to remove oil, grease and dirt from the metal surfaces at least to the degree which is required for a satisfactory subsequent phosphatizing.

The components of the inorganic builder of the alkaline cleaning solution may consist, inter alia, of di- and trisodium phosphate, condensed alkali phosphates, alkali silicates, alkali carbonates, alkali borates and alkali hydroxides. Complexing agents, such as ethylenediaminetetraacetic acid, nitrilotriacetic acid, polyhydroxycarboxylic acids and phosphonates serve to inhibit precipitation and to increase the cleaning activity. Titanium phosphate may be added to the cleaning solution for an activation for the succeeding coating with zinc phosphate. The surfactants are usually selected from the group consisting of the nonionic and anionic products. In most cases the solutions have a pH value in the range from 9 to 12, preferably from 9.5 to 11.5.

The cleaning bathes may contain active constituents in a total concentration of e.g., 1 to 40 g/l. The cleaning solution may be applied to the parts by dipping and/or spraying of the solution at temperatures of from 30° to 95° C.

In the invention, a zinc phosphate coating is formed on the metal surface by contacting the surface with an aqueous zinc phosphate treating solution which contains 0.4 to 1.7 g/l Zn and in which the weight ratio of $Zn:P_2O_5$ has been adjusted to and is maintained at about 1: (6 to 60).

The phosphatizing solutions may additionally contain one or more additional divalent cations, which preferably include Ni, Mn, Mg and Ca and are usually added in concentrations of from 0.1 to 2 g/l and will be incorporated in part in the phosphate layer and under special conditions will result in a further improvement of the layer quality.

The phosphatizing solutions may also contain at least one oxidizing agent selected from the group consisting of the chlorates, bromates, nitrates, nitrites, peroxides and organic nitro compounds such as m-nitrobenzenesulfonate. These substances are added in the quantities and in the manner which are usual in phosphatizing technology.

The phosphatizing solutions may also contain further additives known per se, such as single and complex fluorides, chlorides, sulfates, polyhydroxycarboxylic acids, polyphosphates, ammonium ions, alkali ions, copper ions, cobalt ions and surfactants.

The parts to be phosphatized are sprayed with and/or dipped into the phosphatizing solution at a temperature of from 25° to 70° C. and for a treating time of from 0.45 to 10 minutes.

The rinsing solutions used in the process in accordance with the invention contain additives which are selected, e.g., from the group of the sodium borates and potassium borates, sodium silicates and potassium silicates, sodium nitrite and potassium nitrite. Rinsing may be effected in one or more steps. In a preferred embodiment of the invention the cleaned composite parts are treated with a rinsing solution which contains alkali borate, alkali silicate and alkali nitrite in a total quantity of up to 5 g/l.

It is also desirable to treat the composite parts with a rinsing solution which has been adjusted so as to have a pH value in the range of from 9.5 to 12.0.

In another preferred embodiment of the invention the composite part is activated before the part is coated with zinc phosphate with an activating bath which contains titanium phosphate and as an additive at least 1 g/l of tetraalkalipyrophosphate. The tetraalkalipyrophosphate may be added as such or generated in situ, e.g., in the form of another substance which contains pyrophosphate together with alkali in the amount required for neutralization. The simplest procedure is to add tetrasodiumpyrophosphate and/or tetrapotassiumpyrophosphate to the activating bath. The concentration of tetraalkalipyrophosphate is preferably not in excess of 4 g/l.

The rinsing solution or solutions is or are enriched during operation with impurities from the preceding step of the process. To ensure that the impurities will not become enriched to a disturbing concentration, the rinsing solutions are replenished with fresh water to which alkali borate, alkali silicate and alkali nitrite have been added in the required quantities. In that step the components carried over from the cleaning solution can be taken into account. It has proved desirable to control the addition of the substances based on a measurement of the electric conductivity of the rinsing solutions.

As the activity of the activating bath gradually decreases over a period of time, that bath is replenished with a concentrate which contains fresh titanium phosphate. In order to prevent an excessive rise of the salt concentration, a portion of the bath may be drained continuously or from time to time and may be reconstituted. Tetraalkalipyrophosphate is preferably added in such quantities that the optimum concentration in the liquor is maintained.

The rinsing and activating solutions are preferably maintained at temperatures below 40° C. The treating times should be selected so that a complete replacement of the liquid which comes from the preceding process step and adheres to the composite parts will be ensured. A treatment time of 0.2 to 1 minute will be sufficient for that purpose depending on the shape of the parts and the kind of rinsing step - dipping or spraying. In many cases the times of the contact with the rinsing solution and the activating bath are much longer owing to the existing plant dimensions and the speed at which the workpieces are transported. The advantages afforded by the process in accordance with the invention will become particularly distinctly apparent under such conditions.

When properly carried out, the process in accordance with the invention results in the formation of phosphate coatings which are highly uniform and free of streaks and spots. When coating with zinc phosphate without a previous activation with a titanium phosphate activating bath, the rinsing with a rinsing solution that contains alkali borate, alkali silicate and alkali nitrite will ensure that satisfactory phosphate coatings will subsequently be formed. However if such activation is intended, the activating liquor must also contain tetraalkalipyrophosphate.

The phosphate coatings produced with the process in accordance with the invention can be used to advantage in all fields in which phosphate coatings are used. They are particularly suitable for preparing composite parts of steel and galvanized steel for painting, particularly by electrophoretic dip painting.

The invention will be explained more in detail and by way of example with reference to the following Example:

EXAMPLE

Automobile bodies consisting of composite parts of steel and galvanized steel were treated in the following sequence of operations:

(a) Preliminary degreasing with an aqueous alkaline cleaning solution consisting of

| | |
|---|---|
| 0.8 g/l | $Na_2B_4O_7.5H_2O$ |
| 0.2 g/l | $Na_2SiO_3.5H_2O$ |
| 0.2 g/l | $Na_5P_3O_{10}$ |
| 0.2 g/l | $Na_4P_2O_7$ |
| 0.2 g/l | $Na_3PO_4$ |

-continued

| | |
|---|---|
| 0.2 g/l | NaOH |
| 0.2 g/l | surfactant |
| balance water | |
| pH | 9.5 to 11.5 |

and sprayed for 45 seconds at 53° C.

(b) Main degreasing with an aqueous alkaline cleaning solution consisting of

| | |
|---|---|
| 4.0 g/l | $Na_2B_4O_7.5H_2O$ |
| 1.0 g/l | $Na_2SiO_3.5H_2O$ |
| 1.0 g/l | $Na_5P_3O_{10}$ |
| 1.0 g/l | $Na_4P_2O_7$ |
| 1.0 g/l | $Na_3PO_4$ |
| 1.0 g/l | NaOH |
| 1.0 g/l | surfactant |
| balance | water |
| pH | 11 ± 0.5 |

That the solution was used at 53° C. by spraying for 10 seconds, dipping for 3 minutes and spraying for 45 seconds.

(c) Rinsing with an aqueous rinsing bath of various compositions (see column 2 Table 1) at up to 40° C. That solution was sprayed for 30 seconds.

(d) Rinsing with an aqueous rinsing bath of various compositions (see column 2 of Table 1). That solution was used at up to 40° C. for spraying for 10 seconds, dipping for 3 minutes and spraying for 14 seconds.

(e) Activating with an aqueous activating bath containing 1 g/l of titanium phosphate as an activating agent and any of various additives (see column 3 of Table 1). That bath was used at 45° C. for dipping for 3 minutes and spraying for 14 seconds.

(f) Phosphatizing with an aqueous solution consisting of

| | |
|---|---|
| 1.2 g/l | Zn |
| 0.8 g/l | Ni |
| 2.8 g/l | Na |
| 1.7 g/l | $NO_3$ |
| 12.0 g/l | $P_2O_5$ |
| 0.15 g/l | $NaNO_2$ |
| balance | water |
| Free acid | 1.1 points |
| Total acid | 20.8 points |

That solution was used at 53° C. for dipping for 3 minutes and spraying for 10 seconds.

(g) Rinsing by spraying (h) Rinsing by dipping (i) Passivating rinsing by dipping (j) Rinsing with deionized water by dipping and spraying.

The compositions of the solutions used in process steps c, d and e were varied and the constitutions of the resulting phosphate layers were evaluated. The results are compiled in the Table.

TABLE

| Cons. No. | Steps c/d (Rinsing) | Step e (Activating) | Evaluation of Phosphate Layer on Steel | Evaluation of Phosphate Layer on Galvanized Steel |
|---|---|---|---|---|
| 1 | No addition | No addition | Highly streaky | Highly streaky with white spots |
| 2 | 0.1 g/l $Na_2B_4O_7$ | No addition | Slightly | No streaks, |

TABLE-continued

| Cons. No. | Steps c/d (Rinsing) | Step e (Activating) | Evaluation of Phosphate Layer on Steel | Evaluation of Phosphate Layer on Galvanized Steel |
|---|---|---|---|---|
| | | | streaky | with white spots |
| | 0.08 g/l $Na_2SiO_3$ 0.05 g/l $NaNO_2$ | | | |
| 3 | 1 g/l $Na_2B_4O_7$ 0.8 g/l $Na_2SiO_3$ 0.5 g/l $NaNO_2$ | No addition | Satisfactory | No streaks, with white spots |
| 4 | 0.1 g/l $Na_2B_4O_7$ 0.08 g/l $Na_2SiO_3$ 0.05 g/l $NaNO_2$ | 2 g/l $Na_4P_2O_7$ | Slightly streaky | Satisfactory |
| 5 | 1 g/l $Na_2B_4O_7$ 0.8 g/l $Na_2SiO_3$ 0.5 g/l $NaNO_2$ | 2 g/l $Na_4P_2O_7$ | Satisfactory | Satisfactory |
| 6 | 1 g/l $Na_2B_4O_7$ 0.8 g/l $Na_2SiO_3$ 0.5 g/l $NaNO_2$ | No separate activation step but addition of 1 g/l titanium phosphate-containing activating agent in step b | Satisfactory | Satisfactory |

It is apparent from the Table that unsatisfactory phosphate coatings were formed in Example 1, in which only water was used for rinsing in steps c and d and the activating liquor did not contain tetraalkalipyrophosphate.

From Example 2 it is particularly apparent that the additive in the rinsing bath results in an improvement but a formation of spots on the galvanized surface of the composite part is not yet avoided.

It is shown in Example 3 that with a properly selected rinsing solution satisfactory phosphate layers will be formed on the steel surfaces but spots will still appear on the galvanized surface of the composite parts because the activating bath which is employed does not contain the required addition of tetraalkalipyrophosphate.

Example 4 shows satisfactory results on the galvanized surface of the steel whereas the steel surface exhibits some streakiness because the rinsing solution does not contain active additives in the required concentrations. Satisfactory results are obtained in Example 5, in which the proper additives are contained in the rinsing solution and in the activating bath.

Example 6 is a repetition of Example 5 without a separate activating treatment. It is apparent that satisfactory phosphate layers can be obtained on both surface areas in that case too but the phosphate coatings have a somewhat higher weight per unit of area than in Example 5.

It will be understood that the specification and examples are illustrative but not limitative of the present invention and that other embodiments within the spirit and scope of the invention will suggest themselves to those skilled in the art.

We claim:

1. A process of producing a phosphate coating on a composite part consisting of steel and galvanized steel, the process consisting essentially of alkaline cleaning the part; rinsing the cleaned part with an aqueous rinsing solution which contains at least 0.2 g/l alkali borate, at least 0.1 g/l alkali silicate and at least 0.05 g/l alkali nitrite; and phosphatizing the rinsed part with a zinc phosphate solution.

2. The process of claim 1 wherein the composite part is contacted with a rinsing solution having a total of the concentrations of alkali borate, alkali silicate and alkali nitrite of up to 5 g/l.

3. The process of claim 1 wherein the cleaned composite parts are rinsed with a rinsing bath having a pH value in the range of from 9.5 to 12.0.

4. The process of claim 1 wherein prior to phosphatizing, the composite part is activated with an activating bath.

5. The process of claim 1 further comprising painting the coated part.

6. The process of claim 5 wherein the painting is electrophoretic dip painting.

7. A process of producing a phosphate coating on a composite part consisting of steel and galvanized steel, the process consisting essentially of alkaline cleaning the part with a cleaning solution which contains titanium phosphate; rinsing the cleaned part with an aqueous rinsing solution which contains at least 0.2 g/l alkali borate, at least 0.1 g/l alkali silicate and at least 0.05 g/l alkali nitrite; and phosphatizing the rinsed part with a zinc phosphate solution.

8. A process of producing a phosphate coating on a composite part consisting of steel and galvanized steel, the process consisting essentially of alkaline cleaning the part; rinsing the cleaned part with an aqueous rinsing solution which contains at least 0.2 g/l alkali borate, at least 0.1 g/l alkali silicate and at least 0.05 g/l alkali nitrite; activating the composite part with an activating bath which contains titanium phosphate and at least 1 g/l tetraalkali pyrophosphate; and then phosphatizing the part with a zinc phosphate solution.

9. The process of claim 8 wherein the activating bath contains up to 4 g/l tetraalkalipyrophosphate.

10. The process of claim 9 further comprising painting the coated part.

11. The process of claim 8 wherein the painting is electrophoretic dip painting.

* * * * *